US010173456B2

(12) United States Patent
Yoon

(10) Patent No.: US 10,173,456 B2
(45) Date of Patent: Jan. 8, 2019

(54) ARTICULATED SHEET BINDER APPARATUS

(71) Applicant: David Yoon, Los Angeles, CA (US)

(72) Inventor: David Yoon, Los Angeles, CA (US)

( * ) Notice: Subject to any disclaimer, the term of this patent is extended or adjusted under 35 U.S.C. 154(b) by 0 days.

(21) Appl. No.: 15/378,230

(22) Filed: Dec. 14, 2016

(65) Prior Publication Data

US 2018/0162155 A1 Jun. 14, 2018

(51) Int. Cl.
*B42F 1/00* (2006.01)
*B42F 5/00* (2006.01)

(52) U.S. Cl.
CPC ..... *B42F 1/006* (2013.01); *B42F 5/00* (2013.01)

(58) Field of Classification Search
CPC ..... B42F 5/00; B42F 1/006; Y10T 24/44769
USPC ..... 24/67.3, 67.5, 67.7, 66.7, 67 R, 545; 248/316.5; 281/21.1
See application file for complete search history.

(56) References Cited

U.S. PATENT DOCUMENTS 457,894 A 8/1891 Shields
881,514 A * 3/1908 Wiedeman ..... B42F 9/001 24/67.7
1,443,522 A * 1/1923 Buchan ..... B42F 9/008 24/67.5
1,633,070 A * 6/1927 Crump ..... B42F 11/02 281/48
1,644,625 A * 10/1927 Babian ..... B42F 9/008 24/67.7
1,865,453 A * 7/1932 Baltzley ..... B42F 1/006 24/545
1,965,554 A * 7/1934 Mainwaring ..... B42F 1/006 24/558
2,109,646 A * 3/1938 Lotter ..... B42F 13/004 281/36
3,441,975 A 5/1969 Shepherd
4,486,032 A * 12/1984 Leahy ..... B42F 7/00 24/67 R
4,809,402 A 3/1989 Rainville
4,934,738 A * 6/1990 Colonna ..... B42F 9/008 281/21.1
5,066,182 A 11/1991 Stonebraker et al.
5,533,236 A * 7/1996 Tseng ..... B42F 1/006 24/67 R
5,733,087 A * 3/1998 Gwyn ..... B42D 3/002 156/908
5,896,624 A * 4/1999 Horswell ..... B42F 1/006 24/545
5,938,241 A * 8/1999 Wilson ..... B42D 1/08 281/21.1

(Continued)

*Primary Examiner* — Jason W San
(74) *Attorney, Agent, or Firm* — Schmeiser, Olsen & Watts LLP

(57) ABSTRACT

A binder system is disclosed that flexibly secures one or more flat objects including by mechanical grasping of flat-shaped or sheet materials in a central spring clamp having a compact cross-sectional geometry that can adapt to several sizes of clamped materials and uses. The spring clamp comprises an elongated tri-folded spine with a flat central portion and flat side portions, and flat cover supports that are attached by hinged means to the side portions of the spine. The flat central portion aids a user in opening and keeping the system in its open configuration. In some aspects the system includes customizable covers attachable to said cover supports.

7 Claims, 11 Drawing Sheets

(56) References Cited

U.S. PATENT DOCUMENTS

| | | | | |
|---|---|---|---|---|
| 5,941,569 | A * | 8/1999 | Solomons | B42D 1/08 281/15.1 |
| 5,944,353 | A * | 8/1999 | Sato | B42F 9/008 281/15.1 |
| 7,356,510 | B2 | 4/2008 | Durand et al. | |
| 7,757,358 | B2 * | 7/2010 | Hoarau | B42F 9/008 24/67 R |
| 7,798,736 | B2 * | 9/2010 | Hoarau | B42F 9/008 24/555 |
| 9,421,811 | B2 * | 8/2016 | Hoarau | B42F 1/006 |
| 9,511,615 | B2 * | 12/2016 | Isserstedt | B42F 1/006 |
| 2007/0114783 | A1 | 5/2007 | Glosh et al. | |
| 2008/0018089 | A1 | 1/2008 | Hoarau et al. | |
| 2011/0047762 | A1 * | 3/2011 | O'Donnell | A45C 1/06 24/557 |
| 2014/0125048 | A1 * | 5/2014 | Hoarau | B42C 7/002 281/45 |
| 2015/0342313 | A1 * | 12/2015 | Antinone | B42F 1/08 342/357.51 |
| 2017/0120664 | A1 * | 5/2017 | Klein | B42F 1/006 |

* cited by examiner

ARTICULATED SHEET BINDER APPARATUS

TECHNICAL FIELD

The present application relates to the securement of objects such as sheet materials and other stackable, paper stock, film, or generally flat or compact items in a mechanical binder without requiring punching or drilling or otherwise defacing or modification of the objects to be secured.

BACKGROUND

Sheet materials such as loose leaf sheets of paper and similar thin stackable materials can be organized and kept in binders of many types. Some binder systems include so-called "three-ring binder" systems consisting of a central spine or hinge apparatus having a plurality (e.g., three) articulated split rings that thread into corresponding holes punched into an edge of the papers to be bound, then the binder rings are snapped shut to form a closed ring shape enclosing and securing the punched papers. Other systems include a pinching mechanism that applies mechanical frictional force to pinch a plurality of sheets between two sides of a clamp. Still other types of binders, sometimes called "spiral notebooks", require drilling many small holes into an edge of the sheets, and then a metal or plastic spiral element is threaded into the small holes all along the drilled edge of the sheets to form a notebook of said sheets. Soft or hard covers can be added to either side of the stack of bound sheets for protection of the sheets against wear and tear.

Most existing binder systems require physical marking or punching or drilling or perforating of the bound sheets such as in the case of three-ring binders. Additionally, most existing notebook systems do not allow a user to configure the contents or their order such as in the case of spiral notebooks systems. Some clamping type binders exist but these are generally too bulky, have non-ideal clamp geometries, and are not flexible for multiple types of use. Other pinching type systems are not mechanically robust and are only suitable for light-weight temporary report formats for a limited number of sheets.

FIG. 1 illustrates a clasp style paper binding system which can be used to secure a few thin sheets such as a few sheets of paper in a report, memo or similar document. The binder consists of substantially an elongated clasp 100 typically made of bendable polymer material such as a hard plastic. The clasp 100 includes a C-shaped cross section having a closed end 102 and an opposing openable end 104. One or more thin sheet stock material 110 can be inserted at a first edge 112 thereof into the clasp 100 through the openable end 104. Thin sheets 110 are secured on one edge thereof referred to as a bound edge 112, and an opposing unbound edge 114 allows a user to flip through the one or more sheets 110. Such clasp style binders are relatively inexpensive and compact, yet they are only suitable for a small number of sheets 110 and cannot withstand excessive mechanical force or stress as this would damage or open clasp 100 causing the sheets to be discharged therefrom and become lost or damaged. Furthermore, this type of binder is limited by the material construction and dimensions of clasp 100, which is usually a thin plastic material and only suitable for basic applications such as containing a few sheets of a report or a memo or other short documents.

FIG. 2 illustrates another type of paper binding according to the prior art. Spring-action binder 200 includes a pair of openable cover panels 202 made of a relatively rigid material such as strong cardboard. The cardboard sides are bound to a spring-loaded tubular spine 210. The tubular spine 210 has a closed rounded back 211 and a pinched openable mouth 212 when viewed in cross section and defines an air gap 214 within the tubular spine 210.

The spring-action binder 200 is operated by spreading apart the two cover panels 202. This causes the spring-loaded spine 210 to expand in cross section at its pinched openable portion 212, which can be pried apart to accommodate a plurality of sheets that are subsequently pinched to secure them in the binder 200.

Binder 200 designs suffer from the bulky design of the spring-loaded tubular spine members 210, especially when coupled with conventional binder cover materials 202. The cross-sectional size of binder spine 210 is larger than desired for most personal use applications, which causes the binder to be about one inch or more in girth no matter how few sheets are secured therein. Also, the curved back 102 of binder spine 100 of FIG. 1 and the curved back 211 of binder spine 210 of FIG. 2 are not conducive to placement of the binder on its back when in an open configuration during use. So these binder types are not convenient for users to open and write or read the contents thereof such as a user might do with an ordinary hard-covered book. The binders of FIG. 2 tend to flop around on their backs from side to side, or rock from side to side when opened and placed on a flat surface such as a table top. Additionally, binder 200 is not conducive to annotations to be made on the exterior of its spine 210 because this spine has a rounded profile 211. Finally, such binders are not ideally suited for archiving on a shelf in a series of continuous binders of this sort, as their bindings 210 do not sit uniformly side by side in a tidy manner, and have different appearance from one to the next depending on the number of sheets placed into binder 200.

An additional challenge with existing sheet binder designs is that they are commonly awkward to hold open and generally do not stay open due to natural inward (closing) resistance by the binding members thereof. Improved designs to overcome some or all of the foregoing challenges are desired.

SUMMARY

As stated above, conventional binders typically require alteration or damage to the sheets being secured. In many instances, it is not desirable to damage or alter the sheets. Existing methods that do not require punching or drilling of the secured sheets, however, have other detracting features, for example poor durability, usability or aesthetic designs.

One or more embodiments hereof are directed to a hinged or articulated mechanical binder for securing a stack of sheets of paper or other flat objects in a bound package, comprising an elongated spine disposed along a longitudinal axis thereof and having a generally three-sided cross section in a plane perpendicular to said longitudinal axis; wherein said spine, in cross section, is contoured to have a central facet and a pair of opposing side facets integrally formed with said central facet from a stiff metallic sheet providing a flexible spring force under stress so as to enable a controlled temporary spreading of said side facets away from one another when stressed in an opening direction and that elastically returns to substantially its original contour when unstressed; wherein the opposing side facets of said spine each has a respective proximal portion integrated with the central facet at a slightly rounded bend, and the opposing side facets each has a distal edge formed into a plurality of co-axial cylindrical hinge ports of a given internal diameter;

said binder further comprising a pair of cover supports formed of a rigid material to allow mechanical attachment of the pair of cover supports to a respective pair of opposing respective notebook covers, each of the cover supports comprising an inner edge thereof and having a plurality of co-axial cylindrical hinge ports of said internal diameter at said inner edge; and wherein the hinge ports of a first one of said cover supports and the hinge ports of a first one of said side facets of the spine are co-axially aligned and sized to mechanically interleave into one another forming a first common channel through which a first hinge pin comprising a solid rod is run to form a first hinge thereof, and the hinge ports of a second one of said cover supports and the hinge ports of a second one of said side facets of the spine are co-axially aligned and sized to mechanically interleave into one another forming a second common channel through which a second hinge pin comprising a solid rod is run to form a second hinge thereof.

The claimed binder secures one or more sheets of material in a clamping spine whose hinged cover supports can be integrated with binder covers or other features to form a usable, durable, economical system for holding the sheets without damaging or puncturing them.

IN THE DRAWINGS

Various embodiments of this invention are described below with reference to the accompanying drawings, in which.

Figure 1:
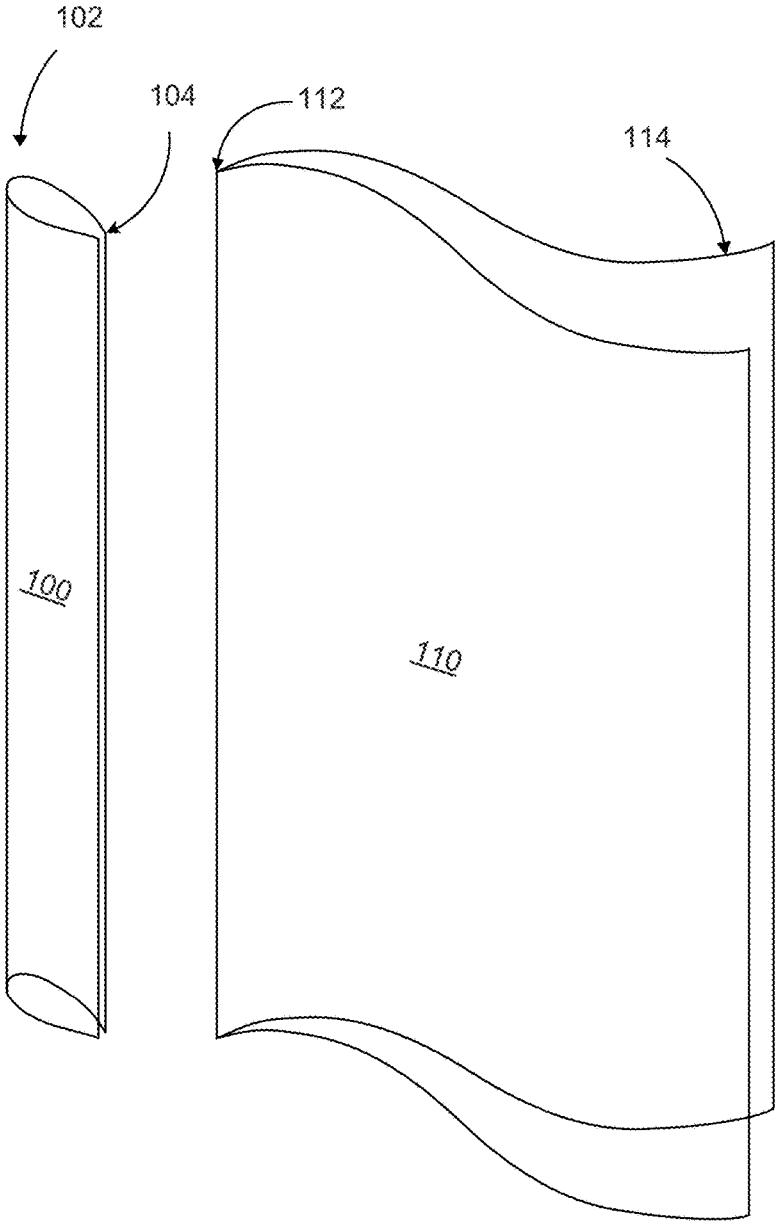
Fig. 1 (Prior Art)
FIG. 1 illustrates a plastic pinching report folder according to the prior art.
Figure 2:
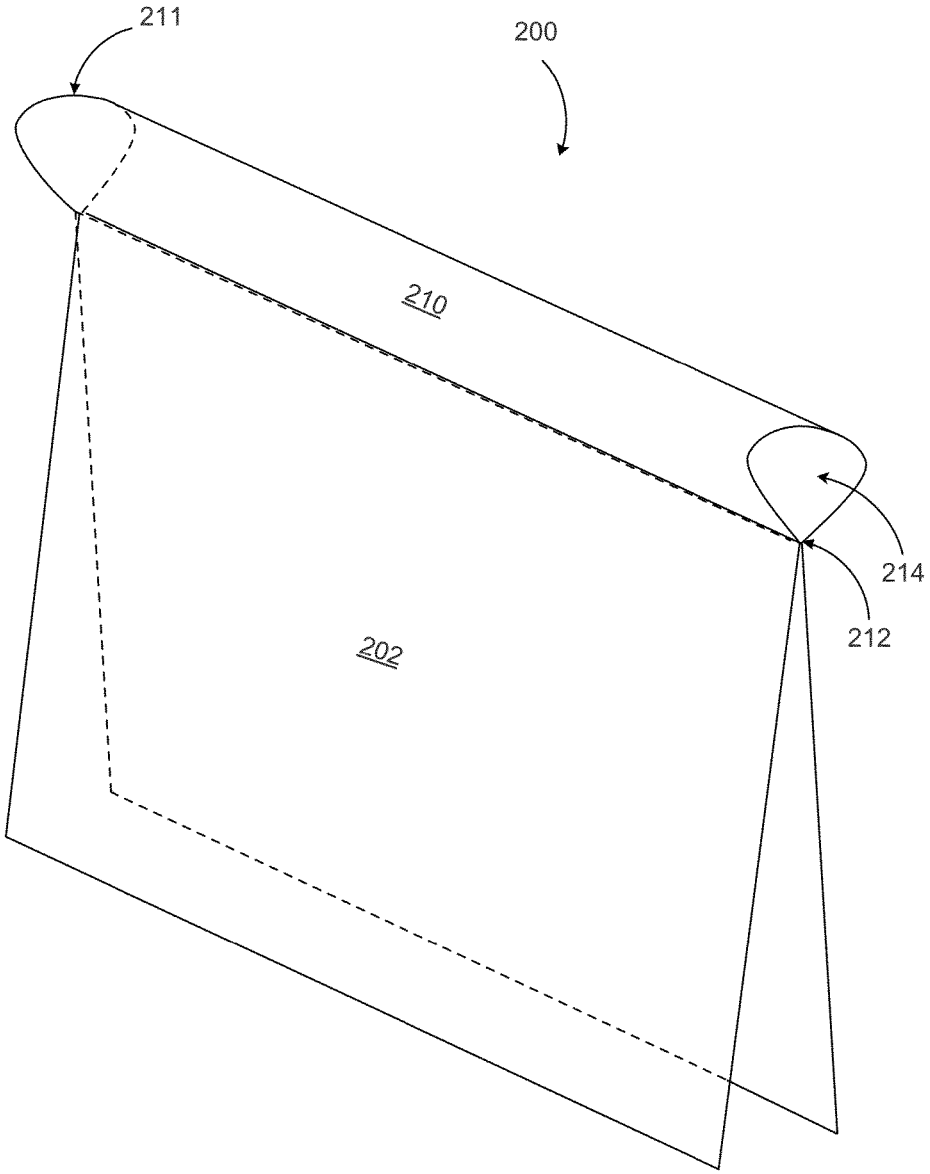
Fig. 2 (Prior Art)
FIG. 2 illustrates a spring-loaded tubular spine binder with hard covers according to the prior art.
Figure 3A:
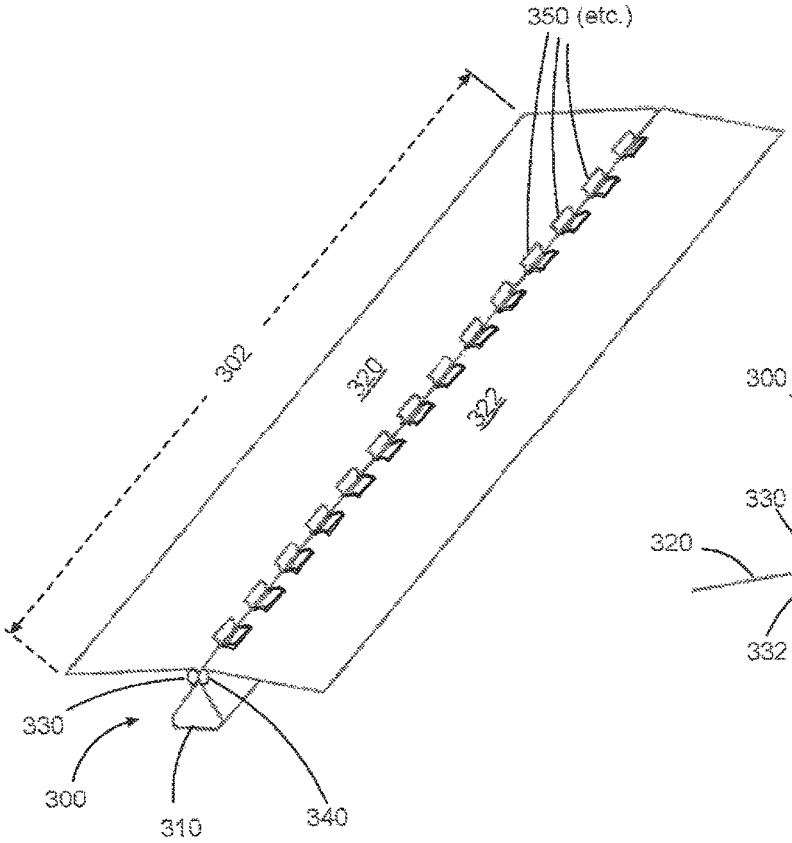
Figure 3B:
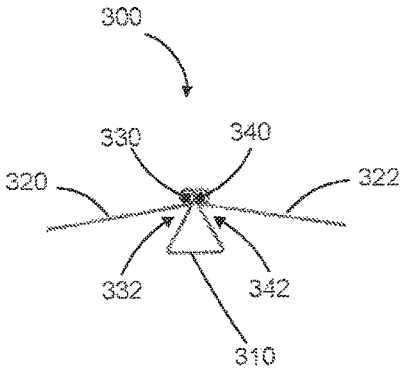
Figure 4A:
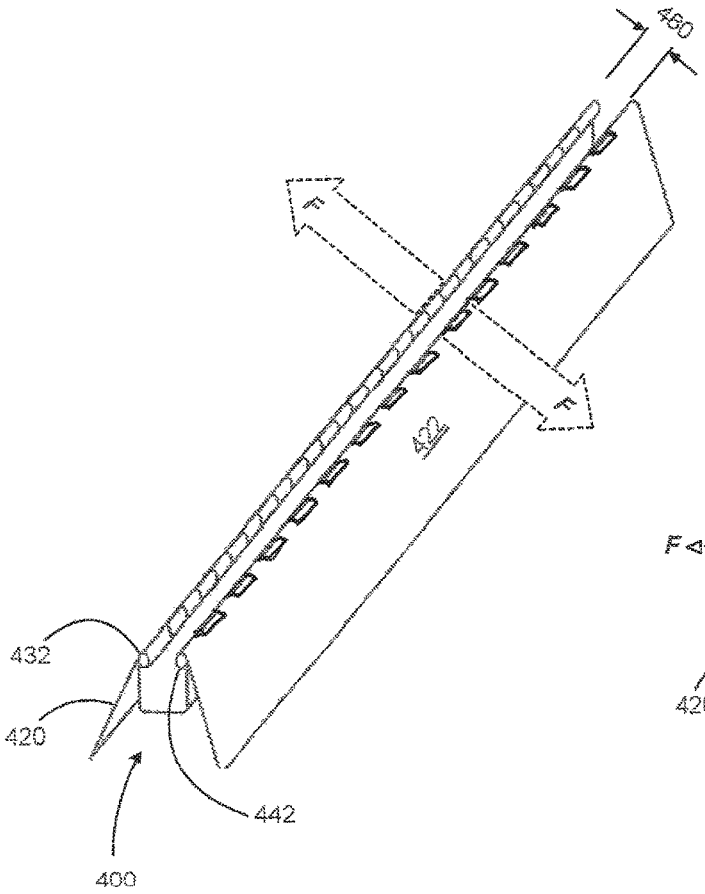
Figure 4B:
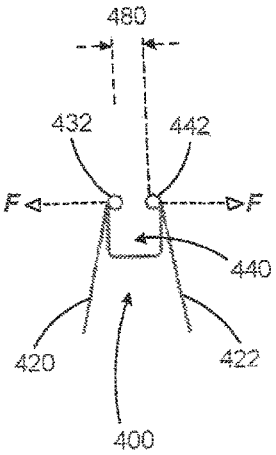
Figure 5A:
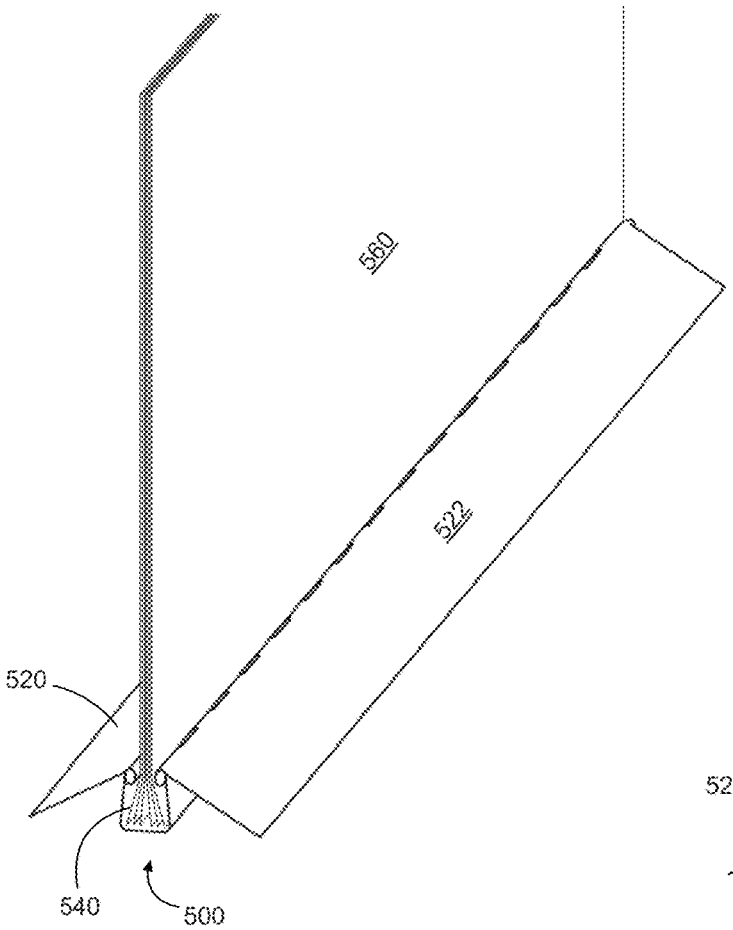
Figure 5B:
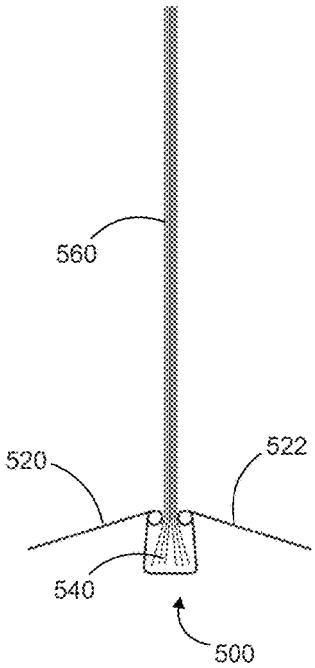
Figure 6:
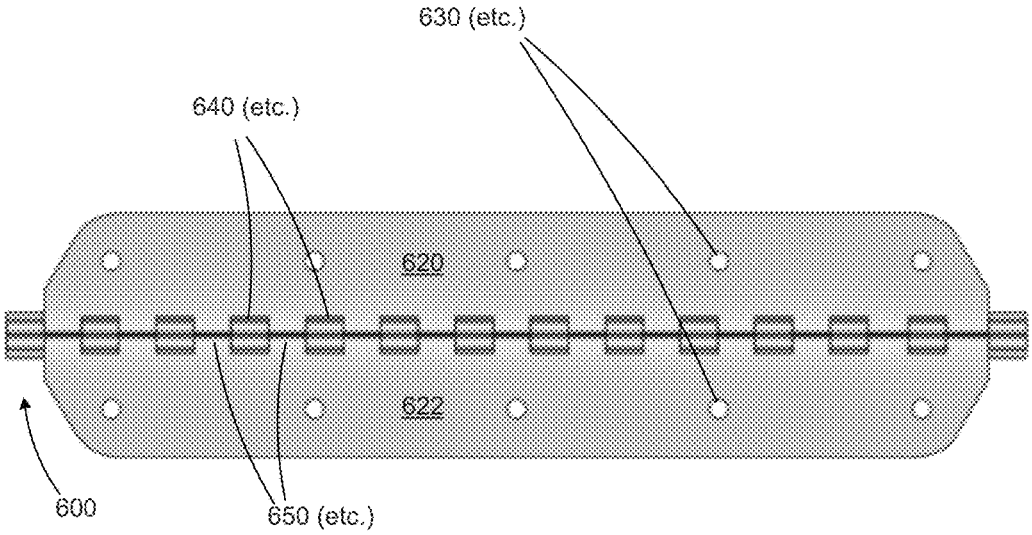
Figure 7:
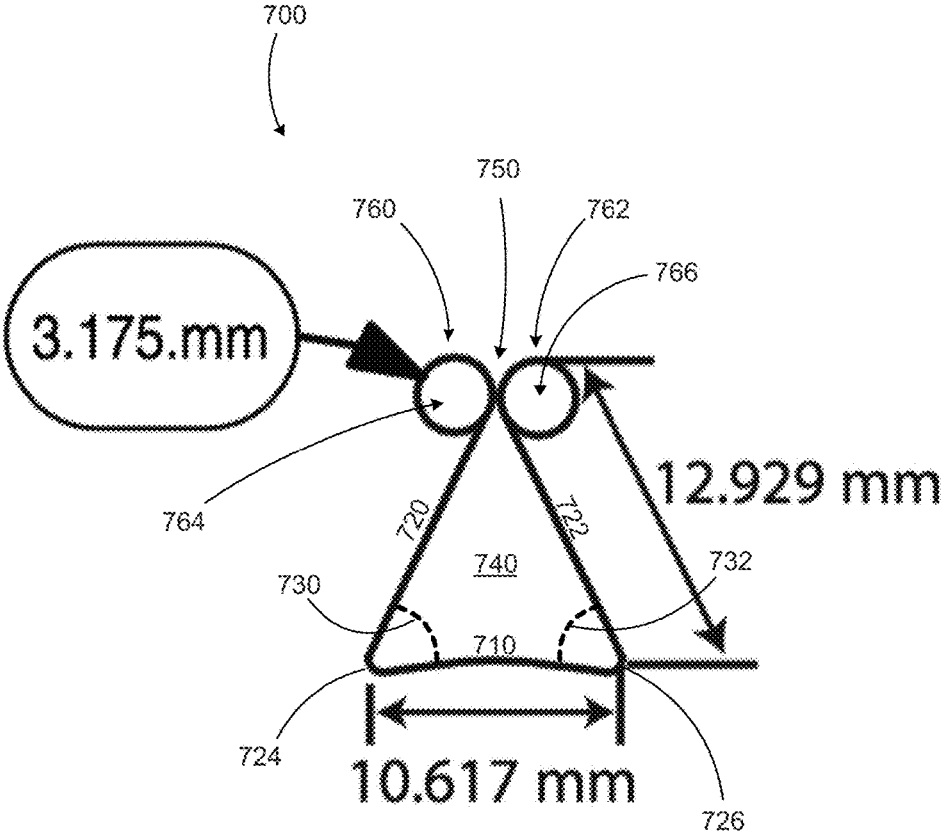
Figure 8:
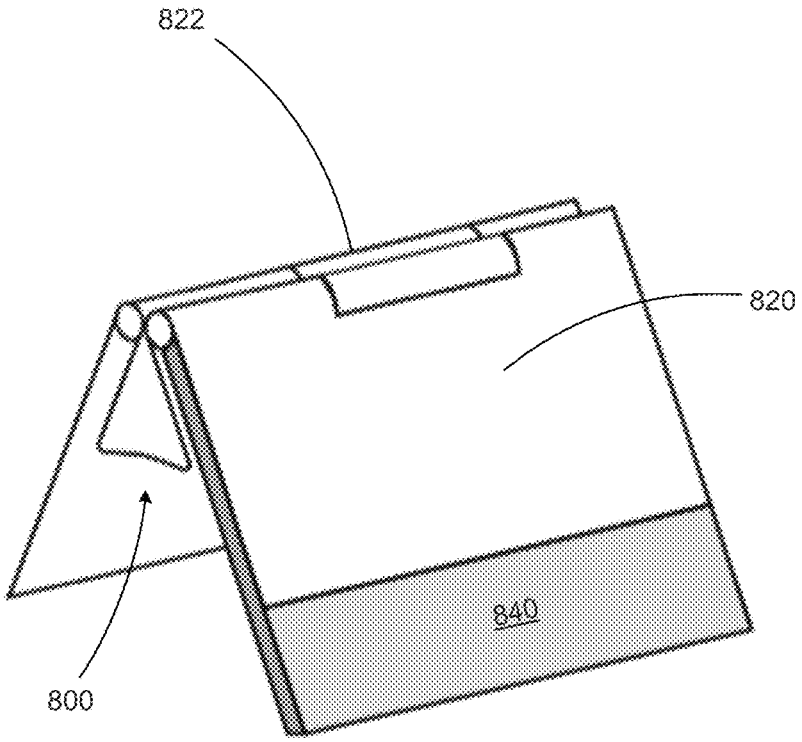
Figure 9:
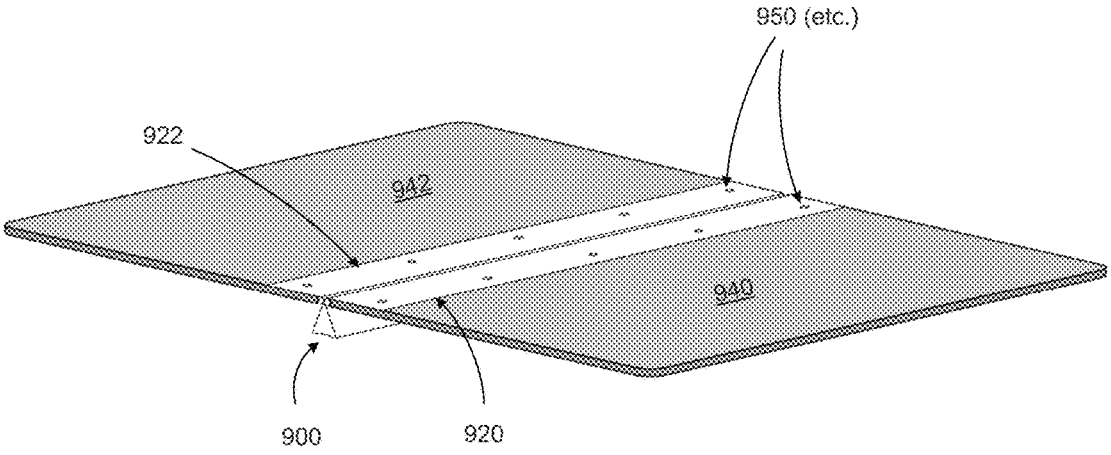
Figure 10:
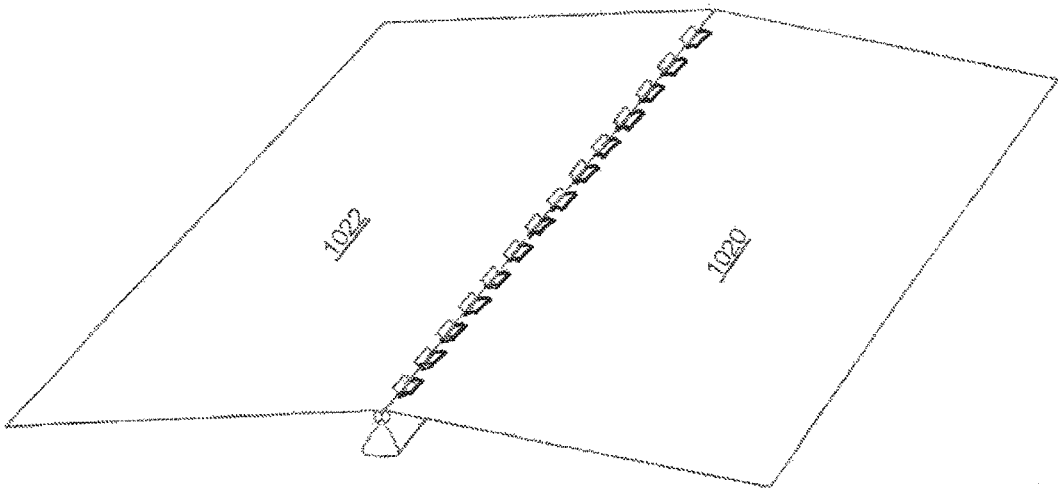
Figure 11:
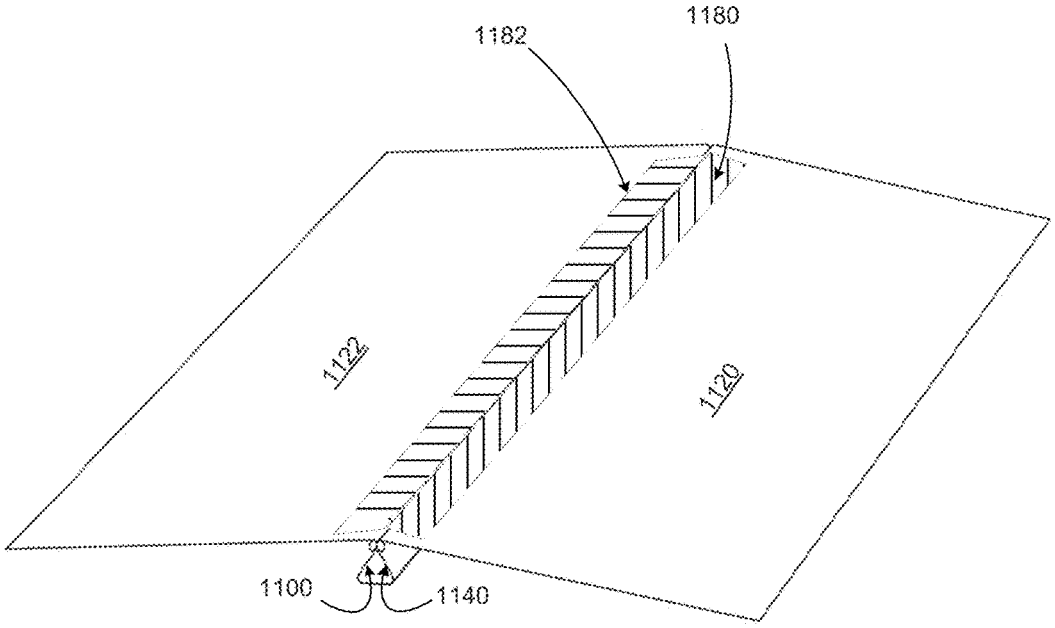

FIG. 3*a* illustrates a perspective view of an exemplary tri-folded clamping spine and attached cover supports, showing such spine in its unloaded configuration;

FIG. 3*b* illustrates a cross-sectional view of an exemplary tri-folded clamping spine and attached cover supports, showing such spine in its unloaded configuration;

FIG. 4*a* illustrates a perspective view of an exemplary tri-folded clamping spine and attached cover supports, showing such spine in its loading/unloading configuration;

FIG. 4*b* illustrates a cross-sectional view of an exemplary tri-folded clamping spine and attached cover supports, showing such spine in its loading/unloading configuration;

FIG. 5*a* illustrates a perspective view of an exemplary tri-folded clamping spine and attached cover supports, showing such spine in its loaded configuration;

FIG. 5*b* illustrates a cross-sectional view of an exemplary tri-folded clamping spine and attached cover supports, showing such spine in its loaded configuration;

FIG. 6 illustrates a planar view of an exemplary tri-folded clamping spine and attached cover supports, looking at inner facets of the hinged cover supports, and the tri-folded spine protruding from underneath;

FIG. 7 illustrates exemplary dimensions a cross-sectional view of a tri folded clamping spine in its unloaded configurations;

FIG. 8 illustrates a perspective view of one embodiment of the present invention, showing a tri-folded clamping spine and attached hinged covers supports with such cover supports attached to rigid boards for use as notebook covers, with such covers shown in their maximally open configuration;

FIG. 9 illustrates the scenario of the previous figure with the notebook covers shown in an open configuration, such that the covers and the central facet of the spine are in a horizontal position;

FIG. 10 illustrates an alternative embodiment of the present invention, whereby the cover supports are wide enough serve as notebook covers, thus dispensing with the need for separate notebook covers; and FIG. 11 illustrates a feature of some embodiments of the present invention whereby durable tape is used to cover the hinge knuckles in order to protect the sheet material contained in the spine.

DETAILED DESCRIPTION

FIGS. 3*a* and 3*b* illustrate, in perspective and cross-sectional (viewed along the longitudinal axis) views, respectively, an exemplary elongated tri-fold clamping spine 300 that can be used to bind a variety of sheet stock or other objects, including paper, plastic sheets, photographs, film, or other sheet material. The elongated tri-fold clamping spine 300 can be made of a longer stock that is cut to length at one or both ends. For example, the length 302 of said elongated clamping spine may be approximately the size of standard paper stock, or slightly longer to accommodate binding of the same. This includes lengths made to be used with binding US Letter, A4, Legal, or other standardized sheets. The clamping spine center section 310 can be made of different dimensions or widths so as to accommodate various sizes of objects to be secured, or to accommodate various numbers of sheets to be secured therein. The spine is attached at each of its edges to flat cover supports 320 and 322, such attachment being by means of hinge pins 330 and 340 that are inserted in the interleaved hinge ports 350 that are formed at the distal edges of tri-fold spine and the proximal edges of the respective cover supports. FIGS. 3*a* and 3*b* show the spine in its "unloaded" configuration, wherein no sheet material is contained in the interior space of the spine, and no external force is applied to the spine, such that the distal ends 332 and 342 of the spine are held together as a result of the spring tension of the spine itself.

FIGS. 4*a* and 4*b* illustrate, in perspective and cross-sectional (viewed along the longitudinal axis) views, respectively, the spine 400 and cover supports 420 and 422 of FIGS. 3*a* and 3*b*, in their "loading/unloading" configuration wherein external equal and opposing forces F are being applied to the distal ends 432 and 442 of the spine so as to temporarily separate such distal ends from each other by a distance 480, allowing sheet material of thickness less than or equal to such distance to be loaded into or unloaded from the interior space 440 of the spine.

FIGS. 5*a* and 5*b* illustrate, in perspective and cross-sectional (viewed along the longitudinal axis) views, respectively, the spine 500 and cover supports 520 and 522 of FIGS. 3*a* and 3*b*, in their "loaded" configuration wherein sheet material 560 has been inserted into the interior space 540 of the spine and is held in place by the distal ends of the spine which are pressed toward each other as a result of the spring tension of the spine.

FIG. 6 illustrates a planar view of one embodiment of the tri-fold spine 300 and attached hinged cover supports 320 and 322 of FIGS. 3*a* and 3*b*. The view is in the plane of the central facet of the tri-fold spine 600, viewed from the side opposite such central facet. The cover supports 620 and 622 are shown in the foreground, and the cover supports include holes 630 for mounting notebook covers to such cover supports 620 and 622. The drawing illustrates in plan view some exemplary features including cover supports 620 and 622, and the tri-fold spine 600, which in this embodiment is slightly longer than the cover supports, can be seen protruding beyond the ends of the cover supports, as well as in the spaces 640 between the hinge ports 650 of the cover supports.

FIG. 7 shows an exemplary cross section, viewed along the longitudinal axis, with exemplary dimensions shown, of the clamping tri-fold spine of the previous drawings. The tri-fold spine structure 700 comprises three primary facets including a center section 710 and two side sections 720 and 722 connected to center section 710 at a pair of respective folds, bends, seams, joints or creases 724 and 726 that are discussed further below. An interior angle 730 and 732 is formed between said center section 710 and each respective side section 720 and 722. In some embodiments, the angle 730 and 732 can be between 45 degrees and 60 degrees in its natural (unloaded) configuration, meaning when at rest and with no material loaded into the interior space 740 of the spine 700. In some embodiments, the angles 730 and 732 can be between 60 degrees and 75 degrees when the spine 700 is in its unloaded configuration. In an embodiment, the interior angles 730 and 732 can be between 70 and 80 degrees in such configuration. The connection between center section 710 and side sections 720 and 722 at folds 724 and 726 creates a three-sided profile of said spine, having two bends or folds or creases or joints 724 and 726 corresponding to each of said side sections 720 and 722 and is sometimes referred to as a tri-fold configuration. This configuration defines a closed end of the spine 700 defined by said center section 710 and an opposing end 750 which can be temporarily opened by the application of a force in the outward direction to each of the edges of the tri-fold spine, through which opened end sheet stock is to be loaded into the interior space 740 of the spine during use. In other words, each side section 720 and 722 is firmly joined to an edge of said center section 710 at a corresponding joint line 724 and 726, but has an edge 760 and 762 distal from said center section surrounding and defining the opening 750, such distal edges comprising cylindrical hinge ports 764 and 766.

In the embodiments shown in FIGS. 3*a*, 3*b* and 6 through 9, the distal edges 760 and 762 of the tri-fold spine 700 are in contact with each other in the spine's unloaded configuration. Such edges are not attached to each other, but are held together by the spring force exerted by elastic action of the spine, which is subject to bending stress even in the unloaded configuration, with such bending stress increasing elastically when a gap between the edges 760 and 762 is created and widened. In another embodiment, there is a natural gap between the distal edges of the tri-fold spine when such spine is in its unloaded position, such gap being of a narrower width than the width of the central facet 710 of the spine, such that the angle 730 and 732 between the center section 710 and the side sections 720 and 722 is an acute angle when the spine is in the unloaded configuration. In this later embodiment, which may be used to accommodate a greater thickness of materials to be bound, the edges 760 and 762 would exert a force toward each other as a result of the spring action of the spine whenever such edges are separated by more than their natural gap of the spine's unloaded configuration, and this force would hold the materials to be bound in place within the spine.

The clamping spine 700 is preferably constructed of a solid yet slightly flexible material such as stainless steel, aluminum, a composite, a very hard polymer or similar substance that is compact yet strong and stiff enough to serve the present function durably and without undue degradation, including repeated opening and closing duty which loaded to carry a plurality of sheet stock in a portable binder device. In an embodiment, the clamping spine is made of half hardened 301 stainless steel of a thickness to be described further below. The other dimensions of the clamping spine 700 will be described in the context of preferred embodiments and configurations further below. In all cases, these dimensions are not intended to be limiting to the present invention, but are illustrative and preferred for the illustrated examples. Those skilled in the art can appreciate variations from the specific examples disclosed.

The cover supports 720 and 722 are preferably constructed of a solid, rigid material, such as chipboard, card stock, acrylic, metal (e.g., aluminum), plastic or wood veneer that is compact, light and strong enough to serve the present function durably and without undue degradation, and that can provide adequate support for cover materials attached thereto.

The hinge ports 764 and 766 along the distal edges 760 and 762 of the tri-fold spine 700 are preferably formed from the same material as the spine and are integral with the spine itself, or such hinge ports could be constructed of any material suitable for the spine itself and firmly attached, by welding or other similar means, to the side facets 720 and 722 of the spine. The hinge ports 650 along the proximal edges of the cover supports 620 and 622 as shown in FIG. 6, similarly, are preferably formed from the same material as and are integral with the cover supports themselves, or such hinge ports could be constructed of any material suitable for the cover supports themselves and firmly attached, by welding or other similar means, to the cover supports.

The hinge pins 764 and 766 are preferably constructed of steel, brass, aluminum or similar metal material; or may be constructed of any material of sufficient rigidity, strength and lubricity to serve the present function durably and without undue degradation, including repeatedly opening and closing the binder while using its contents, as well as being subject to bending stress when the distal edges 760 and 762 of the spine are pulled or pried open in order to load or unload materials into the interior space 740 of the spine.

Each of FIGS. 8 and 9 illustrates, in perspective view, the binder system of the present invention, including a tri-fold clamping spine 800 or 900 with attached hinged cover supports 820 and 822 or 920 and 922 as described above, with notebook covers 840, 940 and 942 attached to the respective distal faces of the respective cover supports. Such notebook covers are preferably constructed of a rigid or semi-rigid material sized so as to cover the sheets contained within the spine. In one embodiment, such notebook covers are constructed of chipboard and have a thickness between 0.08 and 0.10 inches. The length of the respective cover supports can be less than the length of the tri-fold spine, as shown in FIGS. 6 and 8, or the length of the cover supports can be equal to the full length of the spine, as shown in FIGS. 3*a*, 4*a*, 5*a* and 9. The cover supports may be attached to the respective notebook covers by any means allowing firm attachment including the use of rivets, threaded fasteners or adhesives, or any other means known to those skilled in the art. In one embodiment, as shown in FIG. 9, each cover support includes a plurality of holes 950 in order to facilitate attachment to the respective notebook cover. In FIG. 8 the hinged cover supports, along with their attached notebook covers, are opened to the maximum possible extent, with the cover supports and notebook covers parallel with the respective side facets of the tri-fold spine, and with the distal face of each notebook cover in contact with the distal face of such side facet. In this configuration, the notebook covers can be pressed toward each other in order to exert leverage on the tri-fold spine to force apart the edges of such spine, allowing sheets of material to be inserted in or removed from the spine. In FIG. 9, the notebook covers and cover supports are shown opened to a 180-degree angle, in a horizontal configuration. Such configuration can be used when reading or otherwise using the materials that are bound in the spine, and the flat profile of the central facet of the spine allows the binder to be laid stably on a flat surface in the open position shown in FIG. 9. Such configuration can also be used when loading materials in, or unloading materials from, the binder, by pulling outward on the notebook covers in order to temporarily open the tri-fold spine.

In an alternative embodiment, as shown in FIG. 10, the hinged cover supports 1020 and 1022 are wide enough to cover the sheet material contained within the spine, and therefore serve the functions of both the cover supports 920 and 922 and the notebook covers 940 and 942 shown in FIG. 9.

In some embodiments of the invention, the inside of the spine and the knuckles of the hinges are covered with a durable tape to minimize the risk of friction or tearing of the sheet material as it is being inserted in or removed from the spine. FIG. 11 illustrates the use of such tape, where strips of tape 1180 and 1182 are affixed to inside of the spine 1100 and to the cover supports 1120 and 1122 along their respective lengths, so as to cover the hinged portion of such spine and cover supports and to form a barrier between such hinged portion and the interior space 1140 of such spine.

Of course, the dimensions of the apparatus may be modified to suit a particular purpose. For example, the closed (center section) end and/or the open end of the clamping spine may be modified to accept various thicknesses of materials and numbers of sheets. In some embodiments, the material thickness of the sheet stock from which the clamping spine is made may be modified so be durable and commensurate with the size of the objects being clamped. For example, the larger the clamping spine the larger its thickness can be made so as to be sufficiently stiff and durable and so as to apply a sufficient clamping force to the binder's contents.

The present invention should not be considered limited to the particular embodiments described above, but rather should be understood to cover all aspects of the invention as fairly set out in the attached claims. Various modifications, equivalent processes, as well as numerous structures to which the present invention may be applicable, will be readily apparent to those skilled in the art to which the present invention is directed upon review of the present disclosure. The claims are intended to cover such modifications and equivalents.

What is claimed is:

1. A hinged or articulated mechanical binder for securing a stack of sheets of paper or other flat objects in a bound package, comprising:

an elongated spine disposed along a longitudinal axis thereof and having a generally three-sided cross section in a plane perpendicular to said longitudinal axis;

wherein said spine, in cross section, is contoured to have a central facet and a pair of opposing side facets integrally formed with said central facet from a stiff metallic sheet providing a flexible spring force under stress so as to enable a controlled temporary spreading of said side facets away from one another when stressed in an opening direction and that elastically returns to substantially its original contour when unstressed;

wherein the opposing side facets of said spine each has a respective proximal portion integrated with the central facet at a slightly rounded bend, and the opposing side facets each has a distal edge formed into a plurality of integrally formed, co-axial cylindrical spine hinge ports of a given internal diameter, said spine hinge ports being integrally formed with said central facet and said pair of opposing side facets to define a single elongated body articulating as a single unit;

said binder further comprising a pair of cover supports formed of a rigid material to allow mechanical attachment of the pair of cover supports to a respective pair of opposing respective notebook covers, each of the cover supports comprising an inner edge thereof and having a plurality of co-axial cylindrical cover hinge ports of said internal diameter at said inner edge; and wherein the cover hinge ports of a first one of said cover supports and the spine hinge ports of a first one of said side facets of the spine are co-axially aligned and sized to mechanically interleave into one another in a first edge-to-edge, alternating arrangement to form a first common channel through which a first hinge pin comprising a solid rod is run to form a first hinge thereof, and the cover hinge ports of a second one of said cover supports and the spine hinge ports of a second one of said side facets of the spine are co-axially aligned and sized to mechanically interleave into one another in a second edge-to-edge, alternating arrangement to form a second common channel through which a second hinge pin comprising a solid rod is run to form a second hinge thereof.

2. The binder of claim 1, said opposing side facets of said spine being angled inwardly toward each other so as to generally define an open triangular cross-sectional contour of said spine where the proximal portions of said side facets are at a greater distance from one another than the distal edges of said side facets, but where the distal edges of said side facets are not in physical contact with one another so as to retain an opening in said spine between said first and second hinges into which opening a plurality of notebook sheets or other items may be inserted, which opening may be made temporarily wider by subjecting said distal edges to a force separating said distal edges from each other.

3. The binder of claim 1, said opposing side facets of said spine being angled inwardly toward each other so as to generally define a triangular cross-sectional contour of said spine where the proximal portions of said side facets are, in their natural, unstressed position, in physical contact with one another, but which may be temporarily separated by subjecting said distal edges to a force separating said distal edges from each other, so as to produce an opening in said spine between said first and second hinges into which opening a plurality of notebook sheets or other items may be inserted.

4. The binder of claim 2, the spine of said binder exerting an inward clamping force when the first and second hinges are spread apart.

5. The binder of claim 2, in which said central facet is flat or convex towards the interior of said spine, so as to allow said binder to lie in a stable position on a flat surface while said notebook covers are in an open position.

6. The binder of claim 1, wherein said cover supports are of sufficient width perpendicular to the length of the spine to cover the material contained said binder without the use of separate, attached cover supports.

7. The binder of claim 1, wherein said plurality of spine hinge ports are aligned with one another so that said given internal diameter of each of said spine hinge ports is coaxial with one another prior to being assembled with said cover supports.

* * * * *